United States Patent [19]

Ho

[11] Patent Number: 4,974,613

[45] Date of Patent: Dec. 4, 1990

[54] HAIR CURLER

[75] Inventor: Elizabeth Ho, Kowloon, Hong Kong

[73] Assignee: Windmere Corporation, Miami Lakes, Fla.

[21] Appl. No.: 350,358

[22] Filed: May 10, 1989

[51] Int. Cl.[5] ..... A45D 2/24

[52] U.S. Cl. ..... 132/259; 132/255

[58] Field of Search ..... 132/254, 255, 256, 260, 132/258, 259, 257, 295, 245

[56] References Cited

U.S. PATENT DOCUMENTS

| | | | |
|---|---|---|---|
| 2,611,378 | 9/1952 | King et al. | 132/259 |
| 4,498,489 | 2/1985 | Bornhauser | 132/245 |

FOREIGN PATENT DOCUMENTS

| | | | |
|---|---|---|---|
| 963368 | 5/1957 | Fed. Rep. of Germany | 132/255 |
| 579290 | 7/1958 | Italy | 132/255 |
| 696026 | 8/1953 | United Kingdom | 132/255 |
| 2005137 | 4/1979 | United Kingdom | 132/254 |

*Primary Examiner*—Gene Mancene
*Assistant Examiner*—Michael Lynch
*Attorney, Agent, or Firm*—Dickstein, Shapiro & Morin

[57] ABSTRACT

A hair curling roller having an oval-shaped, elongated body with two rounded ends and a U-shaped clip attached to an annular pivotal housing embedded through one rounded end of the body. The opposite end of the U-shaped clip has an enlarged spherical tip adapted to slide over a groove which extends through the rounded end of the oval-shaped body. As the sperical tip slides over the groove, the clip is pulled towards the oval-shaped body, securing any hair wound around the roller. In an alternate embodiment the traverse cross-section of the body is circular in shape and the clip is rotatably secured to the body by a ball and socket.

20 Claims, 4 Drawing Sheets

VIII
VIII

HAIR CURLER

BACKGROUND OF THE INVENTION

The present invention relates to hair curling implements and particularly to hair rollers having a hair clasping device integral to the roller.

Non-bendable hair curling rollers typically require a bobby pin or hair clasp of some sort to hold the hair and prevent it from unwinding. Hair rollers which require bobby pins to secure hair to the rollers suffer from a number of disadvantages. Namely, bobby pins are difficult to manipulate with one hand and are easily dropped or lost. In addition, when a significant thickness of hair is wound around the roller, a bobby pin may have difficulty securely clasping the hair to the roller if it has been bent out of shape or has lost its resiliency.

Other rollers have hair clasping devices attached to the rollers themselves in order to eliminate the problem of having separate rollers and hair clasps. One type of attached hair clasp is a rubber-type strap which is secured to one end of the roller. By stretching the strap around the roller and attaching the free end of the strap to a pin or the like mounted on the roller, the wound hair is secured to the roller. This sort of strap suffers from deterioration and breakage after a relatively short period of use. Moreover, such a flexible rubber strap does not firmly hold hair to the roller when only a small thickness of hair has been rolled.

Another type of attached hair clasp is a thin rectangular frame pivotally-connected to one end of the roller. When hair is wound around the roller, the frame is snapped into place at the end opposite the pivotal end of the roller. This frame-type clasp has the disadvantage of being awkward to use.

Another type of attached hair clasp is a finger-type member which is pivotally-attached at one end of the roller and which snaps into place at the other end of the roller into a small recess. This clasping device suffers from the disadvantage that the tip of the finger-type member which snaps into the small recess is often worn down or broken and the tip no longer adheres to the recess.

SUMMARY OF THE INVENTION

The present invention provides a hair curling roller which alleviates to a great extent the problems of the prior hair curling rollers and having an elongated body with two rounded ends and a U-shaped clip pivotally joined at one rounded end of the body. The opposite end of the U-shaped clip has an enlarged spherical tip adapted to slide over a groove which extends through the other rounded end of the oval-shaped body. As the tip slides over the groove, the U-shaped clip elastically deforms to allow the tip to move over the apex of the rounded end. As the tip passes the apex of the rounded end and slides in the groove on the other side of the apex, the clip relaxes and is pulled towards the body and assumes its original shape thereby securing the hair wound around the roller. The traverse cross section of the body may be circular, oval, elliptical, rectangular or have another shape.

Such a construction of an elongated body, coupled with a U-shaped, pivotal clip does not suffer the disadvantages of the prior art hair clasp devices.

It is an object of the present invention to provide a hair curling roller having a U-shaped clip pivotally attached to the roller for clasping hair wound around the roller without the aid of detached hair clips or bobby pins.

It is another object of the present invention to provide a hair clasping device pivotally attached to the roller body which may be quickly and easily snapped into a groove at the end of the curler roller.

It is a further object of the present invention to provide a hair clasping device integrally coupled to the hair curling roller such that the clasp may be universally moved to allow for unobstructed winding of hair about the roller.

It is a further object of the present invention to provide a hair curling roller having a hair clasping member integrally attached to the roller which can firmly secure any thickness of hair wound around the hair curling roller.

Other objects and advantages of the present invention will be readily apparent from the description and drawings which follow.

DETAILED DESCRIPTION OF THE PREFERRED EMBODIMENTS

Referring to FIGS. 1 to 6, wherein are front, right side, back, left side, bottom and top view respectively of the hair curler roller indicated at 10, according to the present invention. The roller 10 has a generally oval-shaped, elongated body 11 having two rounded ends 18 and 19. The roller body 11 has a number of helically contoured grooves 12 molded in the surface of the roller body 11 for facilitating the winding of hair around the roller body 11 by providing ridges which grip the hair. The cross-sectional shape of the roller body 11 may be oval, elliptical, rectangular, circular, or any shape suitable for winding hair. In the preferred embodiment, the cross-sectional shape of the roller body 11 is generally oval.

Figures 1, 2, 3, 4, 5, 6:
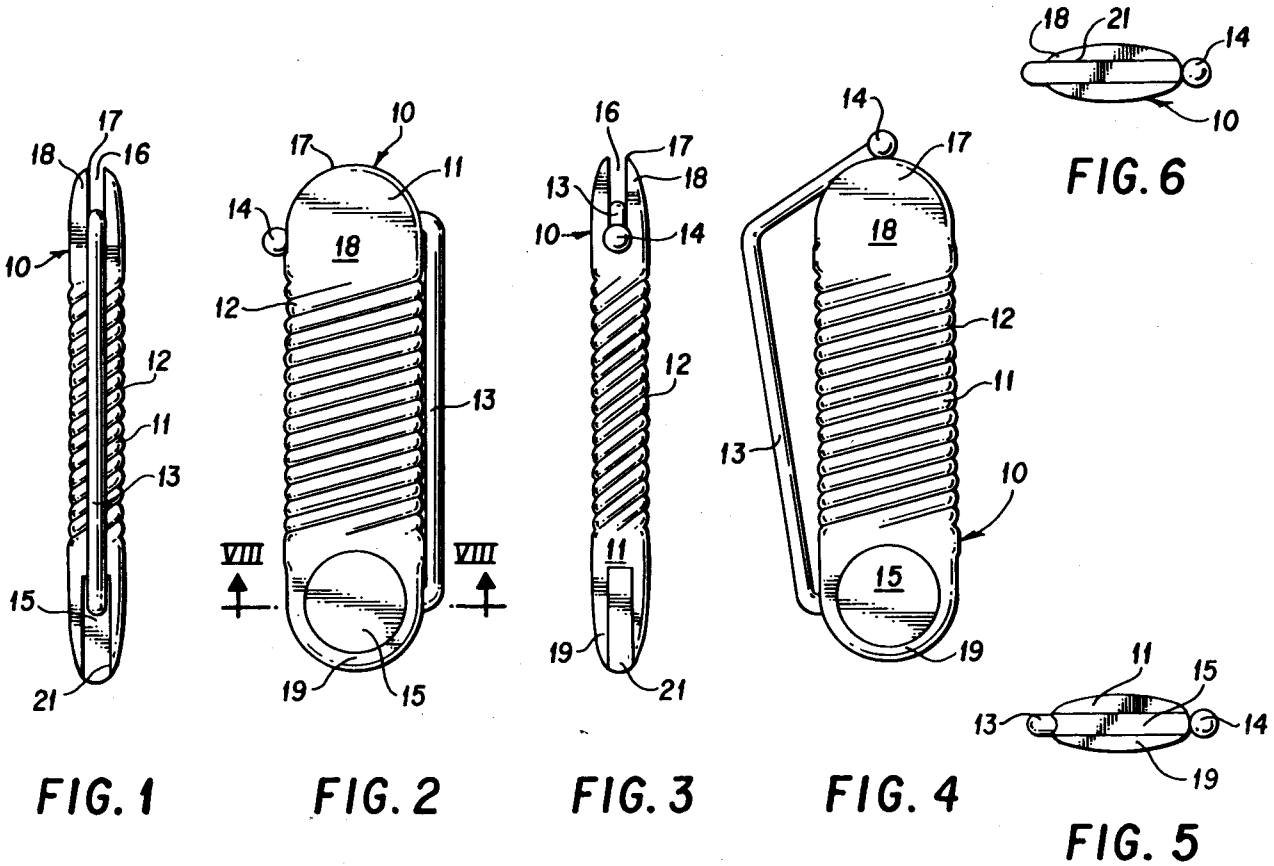
FIG. 1 is a front view of the hair curling roller according to the present invention.
FIG. 2 is a right side view of the roller of FIG. 1.
FIG. 3 is a back side view of the roller of FIG. 1.
FIG. 4 is a left side view of the roller of FIG. 1 showing the clip extending to the apex of the curler body.
FIG. 5 is a bottom side view of the roller of FIG. 1.
FIG. 6 is a top side view of the roller of FIG. 1.
Figure 7:
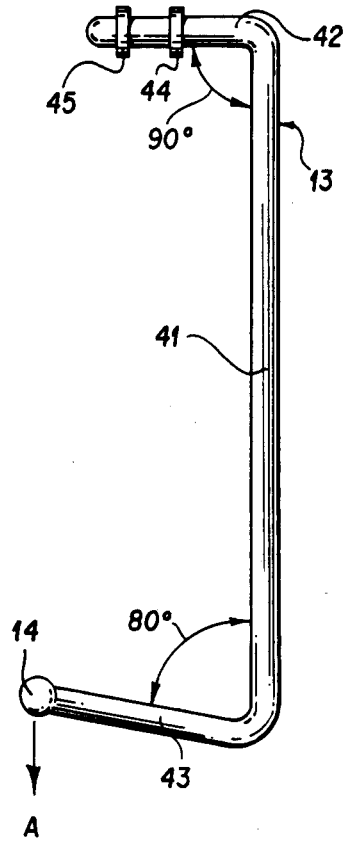
FIG. 7 is a side view of the hair clasping device according to the present invention.

A U-shaped, hair clasping clip 13 is attached at one end to the roller body 11 at a pivotal assembly 15. The opposite end of the U-shaped clip 13 has an enlarged spherical tip 14. The spherical tip 14 slides over the rounded end 18 of the roller body 11 along a groove 16 which has been molded through the rounded end 18 of the roller body 11. The width of the groove 16 is wide enough to allow the leg 43 of the clip 13 (FIG. 7) to pass through the groove 16 but narrow enough to prevent the spherical tip 14 from entering the groove 16. As the spherical tip 14 slides over the groove 16 the U-shaped clip 13 elastically deforms to allow the tip 14 to move over the apex 17 of the rounded end 18 (FIG. 4). As the tip 14 passes over the apex 17 of the rounded end 18 and slides in the groove 16, on the other side of the apex 17, the leg 43 of the clip 13 (FIG. 7) is pulled into the groove 16. The clip 13 is pulled towards the body 11 and relaxes towards its original shape, thereby securing the hair wound around the helical contours 12 to the body 11.

Figure 8:
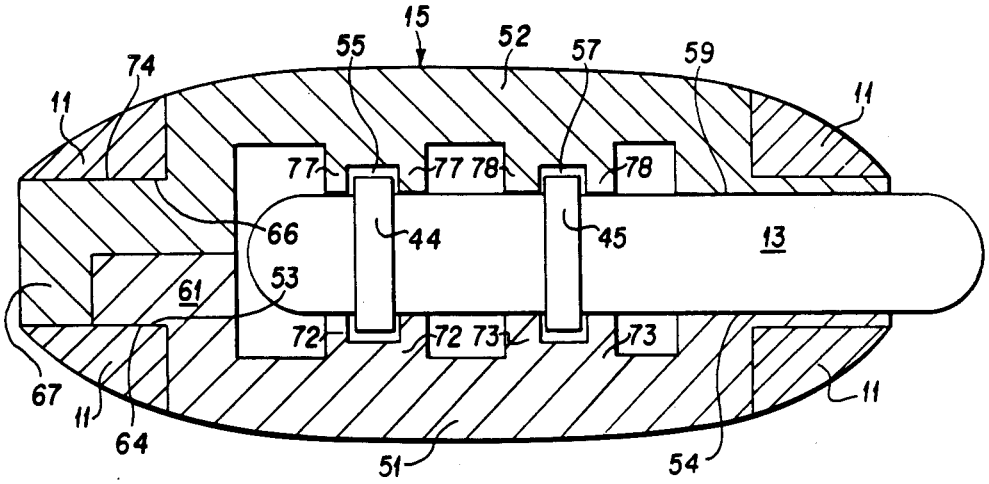
FIG. 8 is a partial cross sectional view of the pivotal housing according to the present invention which is embedded in the hair curling roller body and coupled to the U-shaped hair clip and is taken along line VIII—VIII of FIG. 2.
Figure 9:
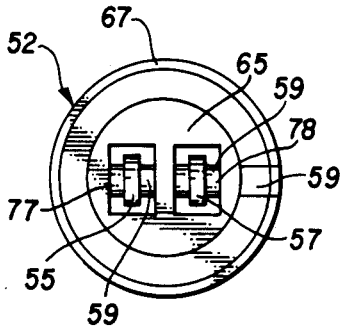
FIG. 9 is a top view of the outer annular housing of the pivotal assembly of the present invention which is embedded in the hair curling roller body and coupled to the U-shaped hair clip.
Figure 10:
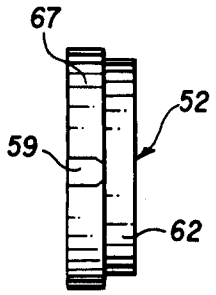
FIG. 10 is a side view of the housing of FIG. 9.
Figure 11:
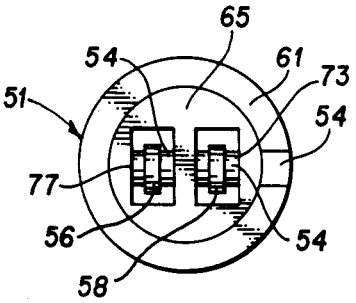
FIG. 11 is a top view of the inner annular housing of the pivotal assembly of the present invention which is embedded in the hair curling roller body and coupled to the U-shaped hair clip.

FIG. 8 shows a cross-sectional view of the clip pivot assembly 15. In assembly, the inner annular housing 51 is fitted into the outer annular housing 52 so that the exterior surface 68 of the inner housing annular flange 61 abuts the interior surface 69 of the outer annular housing flange 67.

The grooves 56 and 58 of the inner annular housing 51 are formed by the groove flanges 72 and 73, respectively. The grooves 55 and 57 of the outer annular housing 52 are formed by the groove flanges 77 and 78, respectively. The U-shaped, clip shaft indicated generally at 13 is coupled through the clip shaft cavities 54 and 59 to the clip pivot assembly 15. The clip 13 is rotatably coupled to the clip pivot assembly 15 by fitting the clip rim 44 into the continuous groove formed by the coupling of the groove 55 to the groove 56 and by fitting the clip rim 45 into the continuous groove formed by the coupling of the groove 57 to the groove 58.

In operation, the leg 42 of the clip 13 rotates in the axis S of the housing 15 shown in FIG. 4. The housing 15 rotates in the axis T of the body 11 shown in FIG. 1 Thus, the clip 13 can be rotated in two directions with regard to the body 11. This rotation allows the leg 43 of the U-shaped clip 13 to be moved away from the roller body 11 during hair curling. Then when the hair winding is completed, the leg 43 of the U-shaped clip 13 is rotated into a position where it can be secured to the body 11 in the groove 16. In addition, by proper rotation, the clip 13 can be positioned on either side of the body 11 and clipped over either side of the groove 16.

Referring again to FIG. 8, the pivot assembly 15 is shown rotatably secured in the roller body 11. A shoulder 53 of the inner annular housing 51 abuts against a first overlapping lip 64 of the roller body 11. Similarly, a shoulder 66 of the outer annular housing 52 is fitted against a second overlapping lip 74 of the roller body 11. The interaction between the housing shoulders 53 and 66 and the respective overlapping body lips 64 and 74 ensures that the clip pivot assembly 15 is embedded flush with the roller body 11. At the same time, a sufficient amount of space is provided between the housing shoulders 53 and 66 and the respective overlapping body lips 64 and 74 so that the pivot assembly 15 may freely rotate about the axis of rotation T.

The U-shaped clip 13 can be rotated into a variety of positions because the clip rim 44 rotates in the clip rim grooves 55 and 56 and the clip rim 45 rotates in the clip rim grooves 57 and 58. With the U-shaped clip shaft 41 rotatable within the pivot assembly 15 and the pivot assembly 15 rotatable within the roller body 11, free motion of the U-shaped clip 13 is possible with respect to the roller body 11. The positionability of the U-shaped clip 13 allows hair to be wound around the body 11 without obstruction or interference from the clip 13.

The roller body 11 can be made of any durable substance such as any number of plastic materials. The U-shaped clip 13 should be made of a flexible yet resilient material which can be elastically deformed without breaking and still be sufficiently resilient so that upon relaxation, the member returns to its original shape. A variety of known synthetic materials can be used for this purpose.

Figure 12:
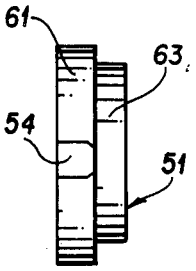
FIG. 12 is a side view of the housing of FIG. 11.

FIG. 12 shows a side view of the inner annular housing 51. The inner housing annular flange 61 adjoins an inner housing body 63.

Figure 13:
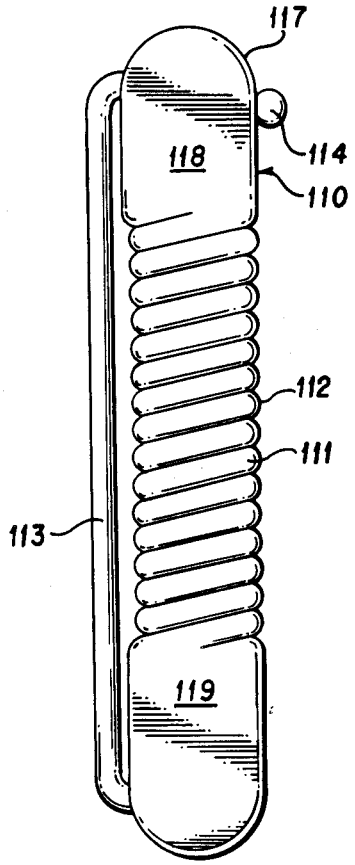
FIG. 13 is a left side view of an alternate embodiment of the hair curling roller of the present invention.

FIG. 13 shows a side view of an alternate embodiment of the curler roller according to the present invention. The alternate embodiment has a circular cross-section 136 (FIG. 15) along the length of the elongated body 111. The elongated body 111 has contours 112 as in the earlier embodiment. The elongated body 111 has rounded ends 118 and 119 at either end.

Figure 14:
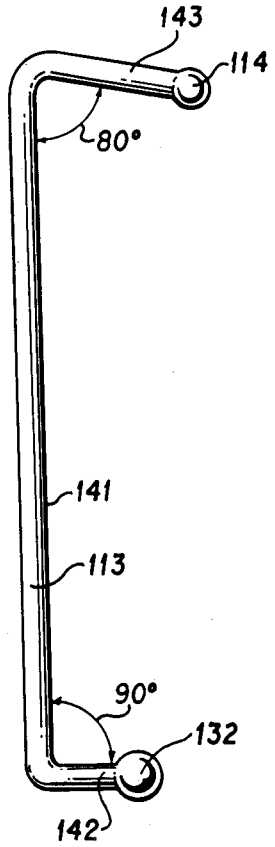
FIG. 14 is a side view of the hair clasping device of the hair curler of FIG. 13.

FIG. 14 shows a side view of the U-shaped clip 113 according to the alternate embodiment. The U-shaped clip 113 is comprised of a shaft 141 and two legs 142 and 143 and is generally circular in cross-section. The leg 142 includes a ball 132 at its end. The angle between the leg 142 and the shaft 141 is preferably approximately 90°. The angle between the leg 143 and the shaft 141 is an acute angle, preferably 80°. As in the earlier embodiment, due to the acuteness of the angle between leg 143 and shaft 141, the U-shaped clip 113 elastically deforms as the rounded tip 114 rides over a groove towards the apex 117 of the rounded end 118. Specifically, the clip 113 is elastically deformed as the tip 114 moves over the apex 117. The elastic deformation of the U-shaped clip 113 relaxes when the spherical tip 114 completes its movement in the groove over the apex 117 thereby pulling the leg 143 into the groove. Once snapped into place, the acute angle between the leg 143 and the shaft 141 and the pressure of the spherical tip 114 against the groove prevent the U-shaped clip 113 from inadvertently being released. Only by forcing the spherical tip 114 over the apex 117 of the rounded end 118 will the clip 113 be released from the groove.

As in the earlier embodiment, the spherical tip 114 not only performs the functions of sliding the clip over the rounded end 118 and guiding the leg 143 into the groove, it also clamps the leg 143 in the groove so that the shaft 141 firmly presses against the hair wound around the roller body 111. Once a hair curl has set, the U-shaped clip 113 can be easily unfastened by forcing the spherical tip 114 so that the spherical tip 114 slides over the apex 117 and free of the rounded end 118 of the roller body 111.

Figure 16:
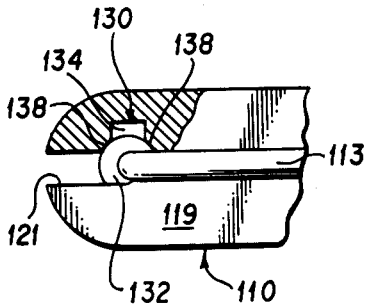
FIG. 16 is a partial cross-sectional view of the curler of FIG. 13 taken along line XVI—XVI of FIG. 15.
Figure 15:
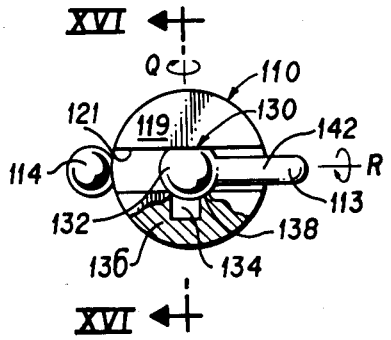
FIG. 15 is a partial cross-sectional view of the bottom side of the curler of FIG. 13.

FIGS. 15 and 16 show partial cross-sectional views of the ball and socket pivot assembly indicated generally by the numeral 130 located in rounded end 119 of the alternate embodiment. FIG. 15 shows a partial cross-sectional bottom view of the alternate embodiment.

FIG. 16 shows a partial cross-sectional view of the side of the alternate embodiment taken along line XVI—XVI of FIG. 15. A groove 121 is molded through the diameter of the circular cross-section 136 at the rounded end 119 of the body 111. The groove 121 is slightly larger than the diameter of the leg 142 and slightly smaller than the diameter of the ball 132. A spherical socket 138 is molded in the center of groove 121 with a slightly larger diameter than the diameter of the ball 132 so as to snugly house the ball 132 of the clip 113. Two rectangular chambers 134 are machined on the sides of the spherical socket 138, perpendicular to the groove 121. During manufacture the ball 132 is positioned within the spherical socket 138. Because the leg 142 is confined within the groove 121, the ball 132 is free to rotate in the axis of rotation Q shown in FIG. 15 When the ball 132 is rotated in the axis of rotation Q, the leg 142 may pivot 180° within the groove 121 and the clip 113 may be pivoted 180°, either away or towards the body 111, thereby clasping the clip 113 to the body 111 as described above. In addition, the ball 132 may be rotated in the axis of rotation R shown in FIG. 15. As with the earlier embodiment, the two directions of rotations of the U-shaped clip 113 allows hair to be wound around the body 111 without obstruction or interference from the clip 113 and the clip 113 to be positioned on either side of the body 111 and clipped over either side of the groove.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is new and desired to be secured by Letters Patent of the United States is:

1. A hair curling roller comprising:

a body having a first end and a second end and a first side and a second side, said first end being rounded and an end groove having an end groove width and extending through the first rounded end;

a pivot structure in the second end; and a clip including a shaft, a first leg extending from one end of said shaft, and a second leg extending from the other end of said shaft, said first leg rotatably mounted within said pivot structure, said second leg having an enlarged tip having an outside dimension larger than said end groove width, said clip and body sized such that said tip may be positioned to slide over said end groove to position said second leg into said end groove with at least a portion of said enlarged tip positioned outside of said end groove and on said second side of said body to hold said shaft towards said first side of said body.

2. The roller according to claim 1, wherein said body is oval-shaped and includes helical contours on its surface for winding hair around said body.

3. The roller according to claim 1, wherein when said clip is secured in said end groove, hair wound around said body is clamped by said clip against said body.

4. The roller according to claim 1, wherein said clip may be released from said end groove by forcing said enlarged tip over and free of said end groove.

5. The roller according to claim 1, wherein said first leg includes at least one rim for engaging said pivot structure.

6. The roller according to claim 1, wherein said pivot structure allows said U-shaped, clip member to rotate in two axes of rotation with respect to said body.

7. The roller according to claim 1, wherein said second leg forms an angle with respect to said shaft such that as said tip slides over said end groove, said clip member is elastically deformed.

8. The roller according to claim 7, wherein said clip member is relaxed when said first leg is seated in said end groove.

9. The roller according to claim 7, wherein said second leg forms an angle with respect to said shaft of between about 30° to 130°.

10. The roller according to claim 7, wherein said first leg forms an angle with respect to said shaft of between about 0° to 180°.

11. The roller according to claim 1, wherein said body is circular in traverse cross-section and includes helical contours on its surface for winding hair around said body.

12. The roller according to claim 1, wherein said pivot structure is a ball and socket structure including a socket formed at the second end of the body; and said U-shaped clip includes a ball at the end of said first leg which is rotatably secured in said socket.

13. The roller according to claim 12, wherein said body is circular in traverse cross-section and includes helical contours on its surface for winding hair around said body.

14. The roller according to claim 12, wherein said second leg forms an angle with respect to said shaft of between about 30° to 130°.

15. The roller according to claim 12, wherein said first leg forms an angle with respect to said shaft of between about 0° to 180°.

16. A hair curling roller comprising:

a body having a first end and a second end, said first end being rounded and an end groove having an end groove width and extending through the first rounded end;

a pivot structure in the second end;

a clip including a shaft, a first leg extending from one end of said shaft, and a second leg extending from the other end of said shaft, said first leg rotatably mounted within said pivot structure, said second leg having an enlarged tip having an outside dimension larger than said end groove width, said clip and body sized such that said tip may be positioned to slide over said end groove to position said second leg into said end groove urging said shaft towards said body to hold hair to said body;

wherein said first leg includes at least one rim for engaging said pivot structure; and wherein said pivot structure is an annular pivotal housing rotatably mounted in said second end including at least one housing groove for engaging said at least one rim of said first leg, said rim being adapted to rotate in said housing groove about an axis of rotation along the axis of the first leg.

17. The roller according to claim 16, wherein rotation of said housing moves said shaft either toward or away from said body.

18. The roller according to claim 17, wherein said housing includes two parallel housing grooves and said first leg includes two parallel rims on said first leg, said rims being adapted to rotate in said two housing grooves.

19. The roller according to claim 16, wherein said pivotal housing allows said U-shaped clip member to rotate in two axes of rotation with respect to said body.

20. A hair curler roller comprising:

a body having a first end and a second end, said first end being rounded and an end groove having an end groove width and extending through the first rounded end;

a pivot structure in the second end;

a clip including a shaft, a first leg extending from one end of said shaft, and a second leg extending from the other end of said shaft, said first leg rotatably mounted within said pivot structure, said second leg having an enlarged tip having an outside dimension larger than said end groove width, said clip and body sized such that said tip may be positioned to slide over said end groove to position said second leg into said end groove urging said shaft towards said body to hold hair to said body;

wherein said pivot structure is a ball and socket structure including a socket formed at the second end of the body;

said U-shaped clip includes a ball at the end of said first leg which is rotatably secured in said socket; and wherein said ball and socket allows said U-shaped clip to rotate in two axes of rotation with respect to said body.

* * * * *